US011474550B2

(12) United States Patent
Ray

(10) Patent No.: US 11,474,550 B2
(45) Date of Patent: Oct. 18, 2022

(54) DUAL LOOP VOLTAGE REGULATOR UTILIZING GAIN AND PHASE SHAPING

(71) Applicant: Samsung Display Co., Ltd., Yongin (KR)

(72) Inventor: Samuel T. Ray, Morgan Hill, CA (US)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/326,985

(22) Filed: May 21, 2021

(65) Prior Publication Data

US 2022/0137655 A1 May 5, 2022

Related U.S. Application Data

(60) Provisional application No. 63/109,999, filed on Nov. 5, 2020.

(51) Int. Cl.

| | |
|---|---|
| ***G05F 1/575*** | (2006.01) |
| ***G05F 1/565*** | (2006.01) |
| ***G05F 1/46*** | (2006.01) |

(52) U.S. Cl.

CPC ..... *G05F 1/575* (2013.01); *G05F 1/461* (2013.01); *G05F 1/565* (2013.01)

(58) Field of Classification Search

CPC ..... G05F 1/575; G05F 1/461; G05F 1/565

See application file for complete search history.

(56) References Cited

U.S. PATENT DOCUMENTS

| | | | | |
|---|---|---|---|---|
| 4,933,625 | A * | 6/1990 | Hayakawa | G05F 1/575 323/280 |
| 6,917,187 | B2 * | 7/2005 | Okubo | G05F 1/569 323/275 |
| 8,417,980 | B1 | 4/2013 | Mimberg | |
| 8,841,893 | B2 | 9/2014 | Bulzacchelli et al. | |
| 9,740,223 | B1 * | 8/2017 | Wang | G05F 1/575 |
| 10,013,005 | B1 * | 7/2018 | Ippili | G05F 1/468 |
| 10,488,875 | B1 | 11/2019 | Olieman et al. | |
| 10,534,385 | B2 | 1/2020 | Singh | |
| 10,698,432 | B2 | 6/2020 | Shih et al. | |
| 2007/0257639 | A1 * | 11/2007 | D'Arrigo | H02J 7/007182 320/128 |
| 2014/0355161 | A1 | 12/2014 | Torres et al. | |

* cited by examiner

*Primary Examiner* — Kyle J Moody
*Assistant Examiner* — Lakaisha Jackson
(74) *Attorney, Agent, or Firm* — Innovation Counsel LLP

(57) ABSTRACT

A voltage regulator includes a first amplifier having a first gain and a first frequency bandwidth, and generating a first voltage output; a second amplifier having a second gain that is lower than the first gain and a second frequency bandwidth that is higher than the first frequency bandwidth, and generating a second voltage output; a summer generating a summed voltage output based on the first voltage output and the second voltage output; and a transistor connected to the summer and generating a regulated voltage based on the summed voltage output of the summer.

20 Claims, 3 Drawing Sheets

DUAL LOOP VOLTAGE REGULATOR UTILIZING GAIN AND PHASE SHAPING

CROSS-REFERENCE TO RELATED APPLICATION(S)

This application claims the benefits of and priority to U.S. Provisional Patent Application Ser. No. 63/109,999 filed Nov. 5, 2020, the disclosure of which is incorporated herein by reference in its entirety.

TECHNICAL FIELD

The present disclosure relates generally to a voltage regulator, more particularly, to a dual loop voltage regulator.

BACKGROUND

Voltage regulators control or adjust a voltage received from a source to meet specific requirements of an electronic device. Voltage regulators may increase or decrease the voltage provided by the source and provide a substantially constant voltage to the electronic device despite variations in current dissipated by the electronic device or fluctuations of the voltage received from the source.

Voltage regulators are used in a variety of electronic devices and systems to provide a constant regulated voltage. Conventionally, voltage regulators may include a high-gain amplifier to reduce a direct current (DC) regulation error. For example, a high-gain amplifier may have a high gain by increasing an output resistance of the amplifier through a combination of techniques such as multiple stages, long transistor channel lengths, cascoding, etc. However, the increased output resistance may decrease a phase margin of the amplifier.

A conventional voltage regulator design may sacrifice a phase margin to achieve a high gain and reduce a DC regulation error or conversely sacrifice DC regulation to achieve a desired phase margin.

SUMMARY

According to one embodiment, a voltage regulator includes a first amplifier having a first gain and a first frequency bandwidth, and generating a first voltage output; a second amplifier having a second gain that is lower than the first gain and a second frequency bandwidth that is higher than the first frequency bandwidth, and generating a second voltage output; a summer generating a summed voltage output based on the first voltage output and the second voltage output; and a transistor connected to the summer and generating a regulated voltage based on the summed voltage output of the summer.

According to another embodiment, a voltage regulator includes a first amplifier comprising an impedance translating transistor and generating a first voltage output; a second amplifier generating a second voltage output; and a pass transistor connected to the first amplifier and generating a regulated voltage based on a voltage output of the first amplifier. The first amplifier has a first gain and a first frequency bandwidth, and the second amplifier has a second gain that is lower than the first gain and a second frequency bandwidth that is higher than the first frequency bandwidth.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of the present disclosure.

BRIEF DESCRIPTION OF THE DRAWINGS

The accompanying drawings, which are included as part of the present specification, illustrate the presently preferred embodiment and together with the general description given above and the detailed description of the preferred embodiment given below serve to explain and teach the principles described herein.

Figure 1:
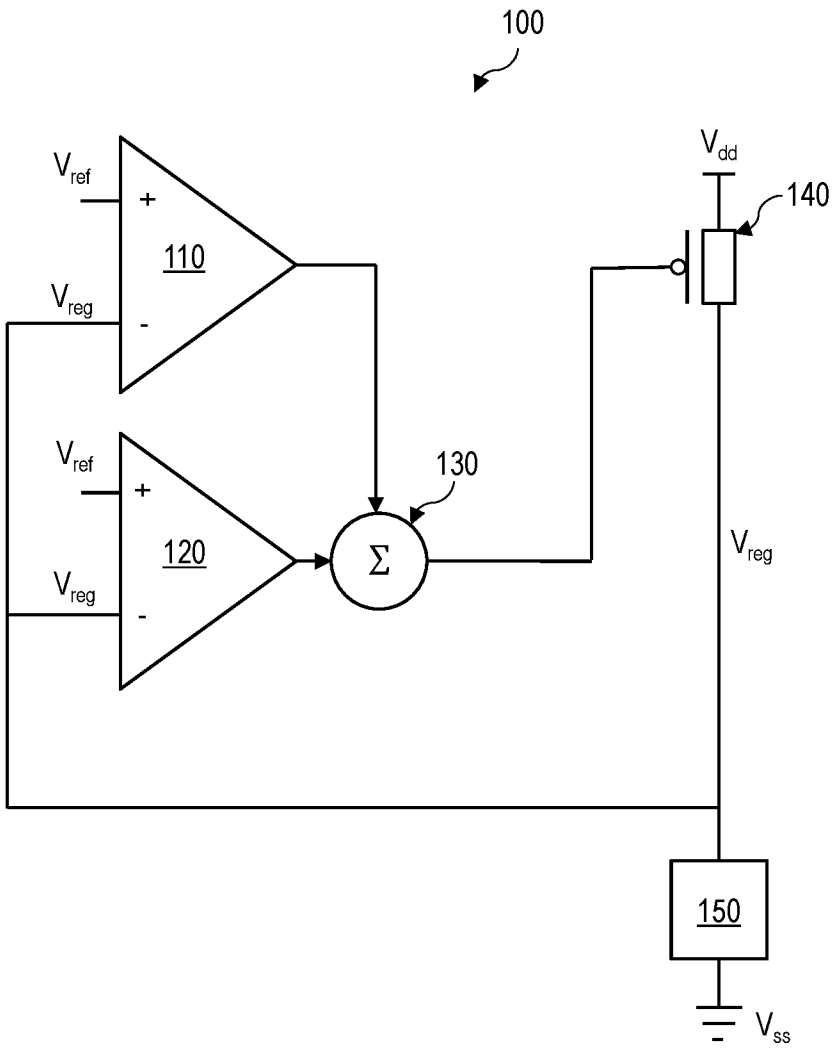
FIG. 1 illustrates a block diagram of a voltage regulator according to an embodiment of the present disclosure.

The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

The present disclosure provides a voltage regulator including two or more amplifiers that may shape both a gain and a phase of the voltage regulator. The voltage regulator may avoid a tradeoff between a high gain and a good phase margin that conventional voltage regulators may experience, as described further herein.

Each of the features and teachings disclosed herein can be utilized separately or in conjunction with other features and teachings to provide a dual loop voltage regulator capable of providing a gain and phase shaping. Representative examples utilizing many of these additional features and teachings, both separately and in combination, are described in further detail with reference to the attached figures. This detailed description is merely intended to teach a person of skill in the art further details for practicing aspects of the present teachings and is not intended to limit the scope of the claims. Therefore, combinations of features disclosed above in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present disclosure. However, it will be apparent to one skilled in the art that these specific details are not required to practice the teachings of the present disclosure.

Some portions of the detailed descriptions herein are presented in terms of algorithms and symbolic representations of operations on data bits within a computer memory. These algorithmic descriptions and representations are used by those skilled in the data processing arts to effectively convey the substance of their work to others skilled in the art. An algorithm is here, and generally, conceived to be a self-consistent sequence of steps leading to a desired result.

The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the below discussion, it is appreciated that throughout the description, discussions utilizing terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of an original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

A voltage regulator that is implemented with only one slow, high-gain amplifier in a feedback loop may provide a good DC regulation, but its transient response speed in a high frequency and the load capacitance may be poor. In contrast, a voltage regulator that is implemented with only one amplifier, for example, fast and low-gain amplifier in the feedback loop may provide a poor DC regulation although its response speed and its load capacitance may be sufficiently good.

The present voltage regulator implements at least two amplifiers including one fast, low-gain amplifier and one slow, high-gain amplifier and sums the outputs of the two amplifiers. The slow amplifier dominates in a low frequency band, and the fast amplifier dominates in a high frequency. Therefore, the present voltage regulator provides a good DC regulation, transient stability, fast response to load changes, and can accommodate a large load capacitance.

The two or more amplifiers included in the present voltage regulator can change the characteristics of the voltage regulator by shaping a gain and a phase of the voltage regulator. The present voltage regulator may avoid a tradeoff between a high-gain and a good phase margin that is inherent in conventional voltage regulators by employing the at least two differential amplifiers.

Further, the present voltage regulator may extend a frequency bandwidth compared to a conventional voltage regulator to accommodate a large output decoupling capacitance (DCAP) or a large change of the DCAP and suppress a ripple in the regulated output voltage. In addition, the present voltage regulator may improve a transient response and attain a replica-regulator-level of power supply rejection ratio (PSRR) without a replica load that matches an actual load. The extended frequency bandwidth of the present voltage regulator allows an open-loop gain to be greater than 1 toward a higher frequency band. If the amplifier gain is less than 1, the PSRR corresponds to a voltage divider of an impedance resistance $R_{o_pass}$ of a pass transistor and a load resistor $R_{load}$. In this case, the PSRR is proportional to $1/(1+A_{openloop})$, where $A_{openloop}$ is the open-loop gain.

FIG. 1 illustrates a block diagram of a voltage regulator according to an embodiment of the present disclosure. A voltage regulator 100 includes a first amplifier 110, a second amplifier 120, a summer 130, and a pass transistor 140. As will be described further below, the voltage regulator 100 provides a high gain for direct current regulation while maintaining a relatively large phase margin by generating an output voltage $V_{reg}$ based on a sum of outputs of the first and second amplifiers 110 and 120.

The voltage regulator 100 is connected between a first voltage $V_{dd}$ and a second voltage $V_{ss}$ via a load 150. The first voltage $V_{dd}$ may be higher than the second voltage $V_{ss}$. For example, the first voltage $V_{dd}$ is 5V, 3.3V, 1.8V, or 1.2V, and the second voltage $V_{ss}$ is zero voltage. The first voltage $V_{dd}$ may also be referred to as a supply voltage, and the second voltage $V_{ss}$ may be referred to as a ground voltage.

The voltage regulator 100 receives a reference voltage $V_{re}$f as an input and generates an output voltage $V_{reg}$ as an output. Each of the first and second amplifiers 110 and 120 may be a differential amplifier that receives two inputs including a first input and a second input, and generates an output that is provided to the summer 130. The first input may correspond to the reference voltage $V_{ref}$, and the second input may correspond to the output voltage $V_{reg}$ of the voltage regulator 100. In other words, the output voltage $V_{reg}$ of the regulator 100 is fed back to each of the first and second amplifiers 110 and 120 as their second inputs. The reference voltage $V_{ref}$ may be provided to each of the first amplifier 110 and the second amplifier 120 as a positive input, and the output voltage $V_{reg}$ is provided to each of the first amplifier 110 and the second amplifier 120 as a negative input. An error between the positive input and the negative input may be compensated to provide the output voltage $V_{reg}$ that is regulated according to the reference voltage $V_{ref}$.

The summer 130 receives the respective outputs from the first amplifier 110 and the second amplifier 120 and generates an output that corresponds to a sum of the first output from the first amplifier 110 and the second output from the second amplifier 120. The output of the summer 130 controls the pass transistor 140 that is connected between the first voltage $V_{dd}$ and the load 150. Based on the output from the summer 130, the pass transistor 140 may generate the output voltage $V_{reg}$ of the voltage regulator 100. The output voltage $V_{reg}$ of the voltage regulator 100 may be determined based on the sum output by the summer 130 and a plurality of parameters including, but not limited to, the first voltage $V_{dd}$, the second voltage $V_{ss}$, and a collector load (herein also referred to as an impedance) of the pass transistor 140, etc. The voltage regulator 100 may output the output voltage $V_{reg}$ despite changes in the load 150.

According to one embodiment, the pass transistor 140 may be a metal-oxide-semiconductor field-effect transistor (MOSFET). In this case, the pass transistor 140 has a drain electrode coupled to the first voltage $V_{dd}$, a source electrode connected to the load 150 and outputting the out voltage $V_{reg}$, and a gate electrode connected to the output of the summer 130. Based on the output voltage of the summer 130, the pass transistor 140 outputs the output voltage $V_{reg}$.

According to one embodiment, the pass transistor 140 may have a cascode structure (not shown) including at least two transistors connected in series, with the first one operating as a common emitter or a common source and the other one as a common base or a common gate. The pass transistor 140 having a cascode transistor can improve input-output isolation and reduce reverse transmission by eliminating direct coupling from the output to the input. As a result, the pass transistor 140 can eliminate the Miller effect and contribute to a higher bandwidth.

The first amplifier 110 has a first gain $A_{fast}$ and a first cut-off frequency $f_{3db_fast}$, and the second amplifier 120 has a second gain $A_{slow}$ and a second cut-off frequency $f_{3db_slow}$. The first and second cut-off frequencies are herein also referred to as 3 decibel (dB) frequencies defining frequency bandwidths of the first amplifier 110 and the second amplifier 120, respectively. At the cut-off frequency, the first and second amplifiers 110 and 120 have a power output that is dropped to half (3 dB) of its peak. The greater a cut-off frequency a device has, the greater the power supply rejection ratio and the phase margin of the device are.

According to one embodiment, the second gain $A_{slow}$ of the second amplifier 120 is greater than the first gain $A_{fast}$ of the first amplifier 110. For example, the second gain $A_{slow}$ of the second amplifier 120 is an order of magnitude greater than the first gain $A_{fast}$ of the first amplifier 110. In this case, the DC accuracy of the output voltage $V_{reg}$ from the voltage regulator 100 is dominantly determined by the second gain $A_{slow}$ of the second amplifier 120. The second gain $A_{slow}$ of the second amplifier 120 may be set to provide a good DC regulation for the voltage regulator 100.

According to one embodiment, the first cut-off frequency $f_{3db_fast}$ of the first amplifier 110 is greater than the second cut-off frequency $f_{3db_slow}$ of the second amplifier 120. In this regard, the first amplifier 110 may be referred to as a fast amplifier, and the second amplifier 120 may be referred to as a slow amplifier. For example, the first cut-off frequency $f_{3db_fast}$ of the first amplifier 110 is an order of magnitude greater than the second cut-off frequency $f_{3db_slow}$ of the second amplifier 120.

Because the output voltage of the voltage regulator 100 is based on a sum of the outputs of the first amplifier 110 and the second amplifier 120, a cut-off frequency $f_{3db_reg}$ of the voltage regulator 100 may be based on both the first cut-off frequency $f_{3db_fast}$ and the second cut-off frequency $f_{3db_slow}$. The cut-off frequency $f_{3db_reg}$ of the voltage regulator 100 may be greater than the second cut-off frequency $f_{3db_slow}$ of the second amplifier 120 (e.g., a higher gain amplifier), as shown and described below with reference to FIG. 3. The second amplifier 120 may provide a high gain (and consequentially DC regulation) while the first amplifier 110 extends a phase margin of the voltage regulator 100. Therefore, the voltage regulator 100 may have both a high gain and a relatively large phase margin rather than trading a phase margin for a high gain.

Further, the outputs of the amplifiers 110, 120 may not "fight" each other due to several reasons. For example, the second amplifier 120 may have a relatively high gain and set current in the first amplifier 110, and the first amplifier 110 may have a relatively low gain and operate at the same current density as the pass transistor 140. This may provide a harmonious operation between the first amplifier 110 and the second amplifier 120.

Figure 2:
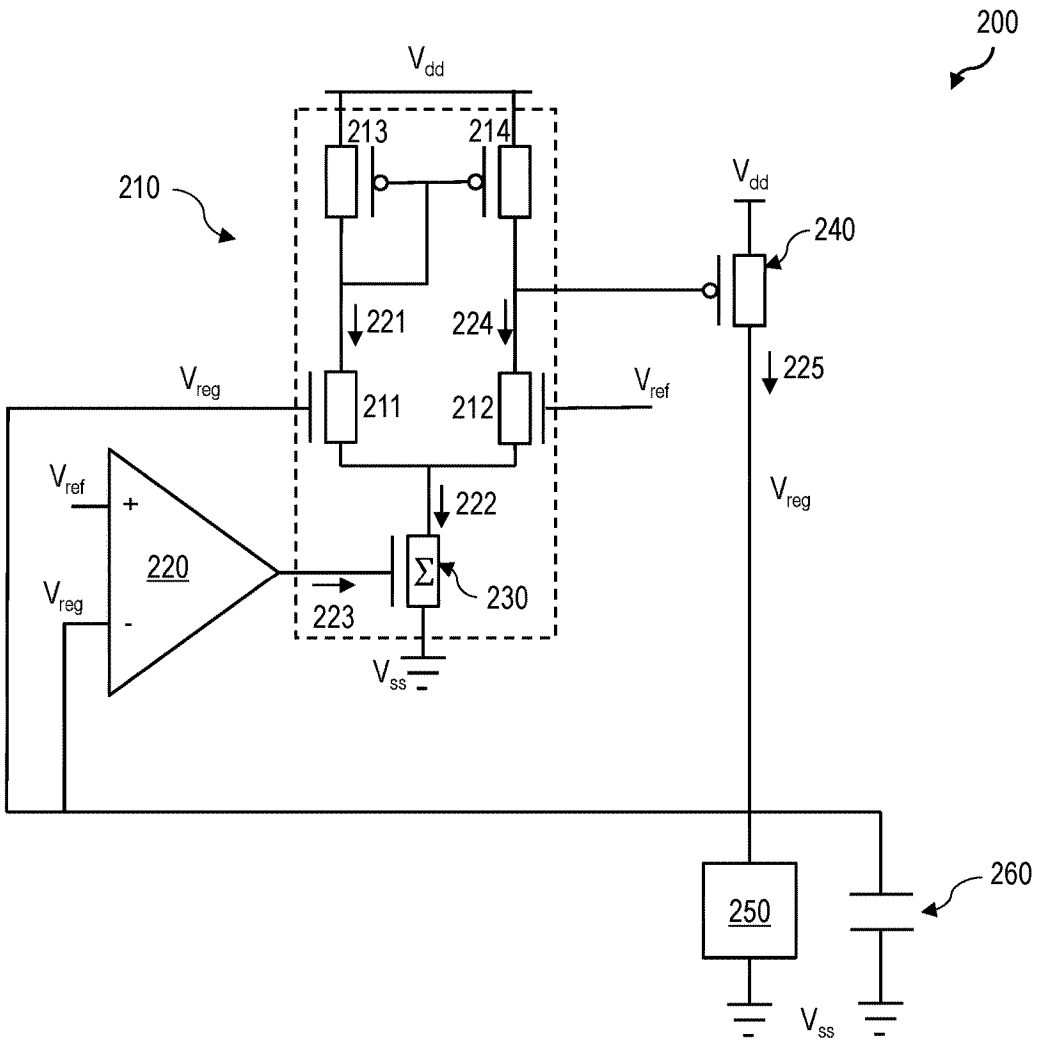
FIG. 2 illustrates a circuit diagram of a voltage regulator according to an embodiment of the present disclosure.

FIG. 2 illustrates a circuit diagram of a voltage regulator according to an embodiment of the present disclosure. A voltage regulator 200 includes a first amplifier 210, a second amplifier 220, an impedance translating transistor 230, and a pass transistor 240. In one embodiment, the first amplifier 210 may include the impedance translating transistor 230. In another embodiment, the impedance translating transistor 230 is separate from and connected to the first amplifier 210. The voltage regulator 200 may be substantially similar to the voltage regulator 100 of FIG. 1 except that the impedance translating transistor 230 may be used to sum the outputs of the first amplifier 210 and the second amplifier 220 instead of using a separate summer (e.g., the summer 130 of FIG. 1). For example, the second amplifier 220 and the pass transistor 240 of FIG. 2 may respectively correspond to the second amplifier 120 and the pass transistor 140 of FIG. 1. The voltage regulator 200 is connected between the first voltage $V_{dd}$ and the second voltage $V_{ss}$ via a load 250 and a capacitor 260. The capacitor 260 may represent a decoupling capacitor that reduces a ripple for the load current at frequencies greater than an open loop frequency bandwidth as well as frequencies below the open loop frequency bandwidth.

According to one embodiment, the first amplifier 210 may be a long tailed differential amplifier. The first amplifier 210 includes four transistors 211, 212, 213, and 214. Among the four transistors 211 through 214, the transistors 213 and 214 forms a current mirror in which their collector circuits are connected to a supply voltage $V_{ss}$. The second amplifier 220 is a fast amplifier that sets the current in the slow amplifier, in the present example, the first amplifier 210. The second amplifier 220 can be considered as a current mirror that is mirroring its current to the pass transistor 240. The mirroring errors must be small enough to not overwhelm the slow amplifier.

The first amplifier 210 has a tail current 222 that is connected to a source of the impedance translating transistor 230 of the first amplifier 210. The tail current source of the first amplifier 210 can serve as a summer by translating impedance from a high impedance of the second amplifier 220 to a low impedance of the first amplifier 210.

Similar to the voltage regulator 100 of FIG. 1, the first gain $A_{fast}$ of the first amplifier 210 of the voltage regulator 200 may be an order of magnitude greater than the second gain $A_{slow}$ of the second amplifier 220 so that the DC accuracy of the voltage regulator 200 is dominantly determined by the second gain $A_{slow}$ of the second amplifier 220 to provide a good DC regulation. In addition, the first cut-off frequency $f_{3db_fast}$ of the first amplifier 210 may be an order of magnitude greater than the second cut-off frequency $f_{3db_slow}$ of the second amplifier 220. In this regard, the first amplifier 210 may be referred to as a fast amplifier, and the second amplifier 220 may be referred to as a slow amplifier. In this case, the transient stability of the voltage regulator 200 may be dominantly determined by the first gain $A_{fast}$ of the first amplifier 210 to provide a good phase margin.

A dominant pole of the voltage regulator 200 may be determined by Equation 1:

$$f_{3db_reg}=1/(2\pi*R_{o\ pass}*C_{load}) \quad \text{(Equation 1)}$$

where $R_{o\ pass}$ is an impedance resistance of the pass transistor 240, and $C_{load}$ is a sum of capacitance values of the capacitor 260 and the pass transistor 240. In a case where the capacitance value of the capacitor 260 is much greater than that of the pass transistor 240, $C_{load}$ may be approximated to the capacitance value of the capacitor 260.

A first non-dominant pole of the voltage regulator 200 may be determined by Equation 2:

$$f_{3db_fast}=1/(2\pi*R_{o\ fast}*C_{gg\ pass}) \quad \text{(Equation 2)}$$

where $R_{o\ fast}$ is an impedance of the first amplifier 210, and $C_{gg\ pass}$ is gate capacitance of the pass transistor 240. A second non-dominant pole of the voltage regulator 200 may be determined by Equation 3:

$$f_{3db_slow}=1/(2\pi*R_{o\ slow}*C_{gg\ slow}) \quad \text{(Equation 3)}$$

where $R_{o\ slow}$ is an impedance of the second amplifier 220, and $C_{gg\ slow}$ is a gate capacitance of the second amplifier 220.

According to one embodiment, the second amplifier 220 may be implemented as a high-gain folded cascode. A folded cascode is a high-gain amplifier architecture that provides a very high gain and a low bandwidth.

According to one embodiment, the transistor 213 may be the fastest amplifier among the transistors 211, 212, 213, and 214 of the first amplifier 210.

According to one embodiment, the transistor 214 and the pass transistor 240 may have a substantially similar channel length. The channel length of the pass transistor 240 may be set to be the minimum channel length that allows a fast bandwidth in a limited area. The first amplifier 210 may have the same minimum channel length so the DC current flowing in the transistor 214 also flows in the pass transistor 240. In this case, the linearity error may be minimized because the output voltage $V_{reg}$ and the reference voltage $V_{ref}$ may be substantially identical at the input of the second amplifier 220, which causes the current 221 to be equal to the current 224, which causes the current 225 to be equal to the current 224. As a result, the first amplifier 210 may have a fast DC bias current $I_{fast}$, and the second amplifier 220 may have a slow DC bias current $I_{slow}$. This may reduce power consumption of the voltage regulator 200 while allowing for tracking and improvement of the DC regulation of the output voltage $V_{reg}$ as well as improvement of a transient response.

According to one embodiment, a self-bias of the currents 221 and 225 allows setting the maximum slewing with the fast DC bias current $I_{fast}$. At DC, when the output voltage $V_{reg}$ is equal to the reference voltage $V_{ref}$, the current 221 is equal to the current 224. Slewing occurs when the current 222 is either the current 221 or the current 224. In this case, the first amplifier 210 may slew at a maximum slewing rate to achieve a new operating point. Increasing the current 222 allows a higher slewing limit at the expense of power consumption.

According to one embodiment, the impedance translating transistor 230 provides impedance translation between the second amplifier 220 that has a high gain, and the fast amplifier that 210 has a low gain.

According to one embodiment, the voltage 223 at the output of the second amplifier 120 provides self-biasing. With the self-biasing, there is no external bias current to bias an amplifier. In the present case, the second amplifier 220 provides the biasing. Self-biasing is advantageous because the circuit adapts to conditions that a bias current cannot.

Since the second amplifier 220 has a higher impedance compared to the impedance of the first amplifier 210, i.e., $R_{o_slow}$ is greater than $R_{o_fast}$, the tail current source of the first amplifier 210 may set the bandwidth of the second amplifier 220. As a result, the voltage regulator 200 can save a surface area of the voltage regulator 200 and enhance common mode rejection through a long channel length. The output impedance $R_{o_fast}$ of the first amplifier 210 is inversely proportional to the bias current; the higher the bias current, the lower the output impedance $R_{o_fast}$ of the first amplifier 210.

According to one embodiment, the channel length of the first amplifier 210 may be reduced since the second amplifier 220 sets the DC regulation. It increases the bandwidth of the first amplifier 210.

According to one embodiment, the first amplifier 210 is a current mirror to the pass transistor 240. The current mirror ratio can be set to provide a good transient response and fast slewing.

Figure 3:
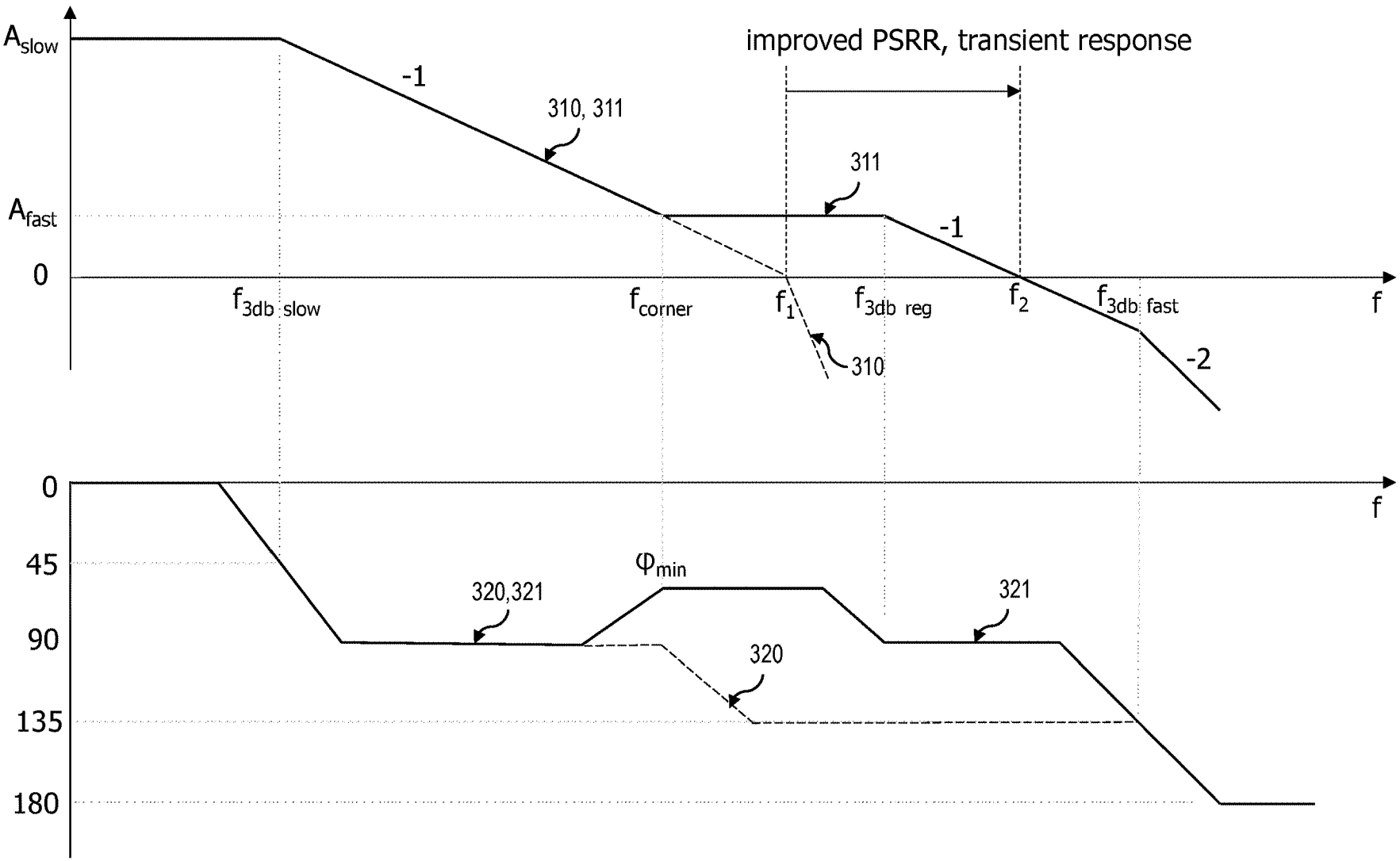
FIG. 3 is a Bode plot of a voltage regulator according to an embodiment of the present disclosure.

According to one embodiment, the dominant pole is at the output of the pass transistor 240 because the fast amplifier pole is very high; this allows large amounts of the decoupling capacitor. Referring to FIG. 3, $f_2$ is an open loop bandwidth. The open-loop bandwidth $f_2$ may be obtained by Equation 4:

$$f_2=1/(2\pi*R_{out}*C_{out}) \quad \text{(Equation 4)}$$

The present voltage regulator 200 may provide stability of a transient response with a desired gain, a desired bandwidth, load capacitance that is decoupled between the first amplifier 210 and the second amplifier 220, allowing easy and convenient adjustments to post layout system-level simulations. After a chip layout is complete, wiring caps and resistances are extracted, but the operating conditions may vary, for example, bandwidths may shrink, and load currents may increase. The voltage regulator 200 may adapt to these conditions. A conventional voltage regulator may easily adapt to these conditions if its regulator architecture is not flexible. The voltage regulator 200 may provide a flexible regulator design that can be easily tuned to meet new load current conditions and demands. This flexible regulator design of the voltage regulator 200 allows a circuit designer to react to the load current conditions and demands particularly during a circuit design process with tight schedules.

Each of the first amplifier 210 and the second amplifier 220 contributes to the shaping of the gain and the phase of the voltage regulator 200. The response of the voltage regulator 200 in a lower frequency band may be dominantly determined by the second amplifier 220 (slow amplifier), but the first amplifier 210 (fast amplifier) may variously shape the response of the voltage regulator 200 in a high frequency band over a much wider range compared to a conventional voltage regulator. The first amplifier 210 of the voltage regulator 200 may improve PSRR by extending the frequency bandwidth of the voltage regulator 200 toward the high frequency band. The improvement PSRR may be obtained at a cost of increasing power consumption.

For example, the second gain $A_{slow}$ of the second amplifier 220 may be set to be proportional to the impedance $R_{o\ slow}$ of the second amplifier 220, and the long channel length. The long channel length in the impedance translating transistor 230 provides high output impedance that provides good common mode rejection. The long channel length in the impedance translating transistor 230 also provides higher capacitance at the gate of the impedance translating transistor 230. This higher capacitance is used to set a first frequency $f_1$ in FIG. 3. In another embodiment, the first cut-off frequency $f_{3db_fast}$ of the first amplifier 210 is inverse-proportional to the impedance $R_{o\ amp}$ and the short channel length and the fast transient current response of the fast DC bias current $I_{fast}$. The short channel length of the first amplifier 210 provides an improved higher frequency response that helps in changing the voltage at the gate of the pass transistor 240. In this manner, a second frequency $f_2$ in FIG. 3 may be set higher.

FIG. 3 is a Bode plot of a voltage regulator according to one embodiment. A Bode plot 300 includes a magnitude (gain) plot and a phase plot that show improvement of the voltage regulator (e.g., the voltage regulator 100 of FIG. 1 and the voltage regulator 200 of FIG. 2) compared to a conventional voltage regulator regarding the magnitude (gain) margin and the phase margin.

Referring to FIG. 2, the voltage regulator 200 sums the outputs of the first (fast) amplifier 210 and the second (slow) amplifier 220. The second gain $A_{slow}$ of the second amplifier 220 governs the response of the voltage regulator 200 in the low frequency band while the first gain $A_{fast}$ of the first amplifier 210 governs the response of the voltage regulator 200 in the high frequency band. Here, the terms slow and fast are relative, and the slow and fast frequency bands may be determined depending on the desired characteristics of the voltage regulator 200. The first amplifier 210 shapes the frequency response of the voltage regulator 200 to meet the PSRR requirement, and the second amplifier 220 sets the first frequency $f_1$ for a given process node and a specified size.

In one embodiment, the voltage regulator 200 of FIG. 2 may have a magnitude (gain) plot 311 and a phase plot 321 shown in FIG. 3. For the purpose of comparison, the magnitude (gain) plot 311 and the phase plot 321 are overlapped with a magnitude (gain) plot 310 and a phase plot 320 of a comparative voltage regulator that includes only a slow and high-gain amplifier (e.g., the second amplifier 220 of FIG. 2). In contrast, the voltage regulator 200 includes both the slow high-gain amplifier (e.g., the second amplifier 220 of FIG. 2) and a fast and low-gain amplifier (e.g., the first amplifier 210 of FIG. 2).

The second amplifier 220 has the second gain $A_{slow}$ and the second cut-off frequency $f_{3db_slow}$, and the first amplifier 210 has the first cut-off frequency $f_{3db_fast}$ that is much higher than the second cut-off frequency $f_{3db_slow}$. A corner frequency $f_{corner}$ may correspond to the frequency at which the slope changes from −1 to zero. This change in the slope is caused by a zero. $f_1$ corresponds to the frequency at which the magnitude plot 310 has a zero gain in the absence of the first amplifier 210. $f_{3db_reg}$ corresponds to the frequency at which the gain of the voltage regulator 200 is down 3 dB from the gain at the magnitude plot 311. $f_2$ corresponds to the frequency at which the gain of the voltage regulator 200 reaches zero dB due to the first amplifier 210 increasing the bandwidth of the voltage regulator 200 compared to one without the fast amplifier 210. The higher bandwidth allows the voltage regulator 200 to react quicker to steps in a load current. $f_{3db_fast}$ corresponds to the pole of the fast amplifier 210, which is the second non-dominant pole. A phase angle (min corresponds to the minimum phase caused by the zero, and improves the gain margin. The phase angle $\varphi_{min}$ may be determined by the cutoff frequency $f_{3db_reg}$ and the first cut-off frequency $f_{3db_fast}$.

The magnitude (gain) plot 310 of the comparative voltage regulator at a low frequency corresponds to the magnitude play of the second amplifier 220 that has the high gain, i.e., the second gain $A_{slow}$ and starts to attenuate at the second cut-off frequency $f_{3db_slow}$. The magnitude (gain) plot 310 may continue to attenuate beyond the corner frequency $f_{corner}$ and cross the zero gain at a first frequency $f_1$. The power supply rejection ratio (PSRR) of the comparative voltage regulator is determined by the first frequency $f_1$. Beyond the first frequency $f_1$, the comparative voltage regulator does not generate an amplified output despite a difference of the input signals.

In contrast, the magnitude plot 311 of the voltage regulator 200 extends beyond the corner frequency $f_{corner}$ due to the first gain $A_{fast}$ of the first amplifier 210. The magnitude plot 311 of the voltage regulator 200 may be substantially flat between the corner frequency $f_{corner}$ and a cutoff frequency $f_{3db_reg}$ of the voltage regulator 200, start to attenuate at the cutoff frequency $f_{3db_reg}$, and cross the zero gain at a second frequency $f_2$. The power supply rejection ratio (PSRR) of the voltage regulator 200 is determined by the second frequency $f_2$. Therefore, the PSRR of the voltage regulator 200 is improved from the first frequency $f_1$ to the second frequency $f_2$. Beyond the second frequency $f_2$, the voltage regulator 200 does not generate an amplified output despite a difference of the input signals.

In one embodiment, each of the first amplifier 210 and the second amplifier 220 may be a first-order amplifier. In another embodiment, each of the first amplifier 210 and the second amplifier 220 may be a second or higher-order amplifier. Depending on the order of the first amplifier 210 and the second amplifier 220, the slope of the magnitude plot may vary. For example, a first-order amplifier filter may have a constant gain in a pass band, and a slope of the gain plot in a stop band is −20 dB/decade.

The first cut-off frequency $f_{3db_fast}$ of the first amplifier 210 may be higher than the second frequency $f_2$. Beyond the first cut-off frequency $f_{3db_fast}$, the magnitude plot 311 of the voltage regulator 200 may have a second order attenuation, e.g., −40 dB/decade.

In one embodiment, the second gain $A_{slow}$ of the second amplifier 220 is approximately ten times greater than the first gain $A_{fast}$ of the first amplifier 210. In this case, the cutoff frequency $f_{3db_reg}$ of the voltage regulator 200 may be higher than the corner frequency $f_{corner}$ and located between a low cut-off frequency, i.e., the second cut-off frequency $f_{3db_slow}$ of the second amplifier 220 and a high cut-off frequency, i.e., the first cut-off frequency $f_{3db_fast}$ of the first amplifier 210. Since the comparative voltage regulator that includes only a high-gain amplifier (e.g., the second amplifier 220) may have a cut-off frequency that is much lower than the corner frequency $f_{corner}$ of the voltage regulator 200, it may not have a good transient response. Because the cutoff frequency $f_{3db_reg}$ of the voltage regulator 200 may be extended from the corner frequency $f_{corner}$, the voltage regulator 200 has an improved bandwidth compared to the comparative voltage regulator and may provide a good transient response at a high frequency. Accordingly, the voltage regulator 200 may have an improved power supply rejection ratio (PSRR) and an improved transient response across the low and high frequencies. Further, since the cutoff frequency $f_{3db_reg}$ of the voltage regulator 200 is shifted from the corner frequency $f_{corner}$, the voltage regulator 200 has an improved phase margin compared to the comparative voltage regulator as well.

Although FIG. 1 shows that the outputs of two amplifiers, i.e., the first and second amplifiers 110 and 120, are summed together, the present disclosure is not limited thereto. For example, the voltage regulator 100 of FIG. 1 may include more than two amplifiers. The voltage regulator 200 of FIG. 2 may also include more than two amplifiers and may sum the outputs of them through each of the amplifier's tail current. One tail current may become multiple tail currents, each of which may have its own separate amplifier.

According to one embodiment, the present voltage regulator may use feed forward currents that are summed at the fast path output to anticipate load step currents. Multiple fast amplifiers may be connected at the gate of the pass transistor 240.

According to one embodiment, the present voltage regulator may be used in or in conjunction with integrated circuits. For example, the present voltage regulator may be used in a high speed serializer/deserializer (SerDes) device. A SERDES may be used in high-speed communications to compensate for limited input ports and output ports by converting data between serial and parallel interfaces bidirectionally. In SERDES, a stable voltage regulator may be necessary for stable conversion of data between remotely (e.g., wirelessly) connected devices.

However, it will be recognized that the present voltage regulator may be used for regulating voltages in other electronic devices including, but not limited to, memory devices (e.g., DDR 4 synchronous dynamic random access memory (SDRAM) devices, DDR4 register devices, DDR4 controller devices), and other high speed data applications. Additionally, the present voltage regulator may be used for a variety of applications such as network and/or computer storage systems, computer servers, handheld computing devices, portable computing devices, computer systems, network appliances and/or switches, routers, and gateways, and the like.

According to one embodiment, a voltage regulator includes a first amplifier having a first gain and a first frequency bandwidth, and generating a first voltage output; a second amplifier having a second gain that is lower than the first gain and a second frequency bandwidth that is higher than the first frequency bandwidth, and generating a second voltage output; a summer generating a summed voltage output based on the first voltage output and the second voltage output; and a transistor connected to the summer and generating a regulated voltage based on the summed voltage output of the summer.

The voltage regulator may further include a feedback loop. Each of the first amplifier and the second amplifier may be a differential amplifier including a first input that receives a reference voltage and a second input that receives the regulated voltage via the feedback loop.

The first amplifier may extend a phase margin of the voltage regulator toward a high frequency.

The transistor may include a drain electrode that is connected to a supply voltage and a source electrode that is connected to a ground voltage, and a gate electrode that is connected to the summer.

The transistor may have a cascode structure including at least two transistors connected in series.

The at least two transistors may include a first transistor serving as a common emitter or a common source and a second transistor serving as a common base or a common gate.

According to another embodiment, a voltage regulator includes a first amplifier comprising an impedance translating transistor and generating a first voltage output; a second amplifier generating a second voltage output; and a pass transistor connected to the first amplifier and generating a regulated voltage based on a voltage output of the first amplifier. The first amplifier has a first gain and a first frequency bandwidth, and the second amplifier has a second gain that is lower than the first gain and a second frequency bandwidth that is higher than the first frequency bandwidth.

The first amplifier may be a long tailed differential amplifier.

The long tailed differential amplifier may include a first transistor and a second transistor connected in series, and a third transistor and a fourth transistor connected in series, and the second transistor and the fourth transistor may be connected to the impedance translating transistor.

The first transistor and the third transistor may form a current mirror, and collector circuits of the first transistor and the third transistor may be connected to a supply voltage.

The first amplifier may set a current in the second amplifier.

The second amplifier may mirror its current to the pass transistor.

The second transistor and the fourth transistor may provide a tail current to a source of the impedance translating transistor.

A tail current source of the first amplifier may serve as a summer by translating impedance from a high impedance of the second amplifier to a low impedance of the first amplifier.

The second amplifier may be implemented as a high-gain folded cascode.

The third transistor and the pass transistor may have a substantially similar channel length.

First current flowing from the first transistor may be substantially similar to third current flowing from the third transistor, and second current flowing through the pass transistor may be substantially similar to the third current flowing through the third transistor.

A voltage at an output of the second amplifier may provide self-biasing.

The voltage regulator may include a feedback loop. Each of the first amplifier and the second amplifier may be a differential amplifier comprising a first input that receives a reference voltage and a second input that receives the regulated voltage via the feedback loop.

The first amplifier may extend a phase margin of the voltage regulator toward a high frequency.

The above example embodiments have been described hereinabove to illustrate various embodiments of implementing a system and method for providing a dual loop voltage regulator that is capable of providing a gain and phase shaping. Various modifications and departures from the disclosed example embodiments will occur to those having ordinary skill in the art. The subject matter that is intended to be within the scope of the present disclosure is set forth in the following claims.

What is claimed is:

1. A voltage regulator comprising:

a first amplifier having a first gain and a first frequency bandwidth, and generating a first voltage output;

a second amplifier having a second gain that is lower than the first gain and a second frequency bandwidth that is higher than the first frequency bandwidth, and generating a second voltage output;

a summer generating a summed voltage output based on the first voltage output and the second voltage output; and a transistor connected to the summer and generating a regulated voltage based on the summed voltage output of the summer.

2. The voltage regulator of claim 1, further comprising a feedback loop, wherein each of the first amplifier and the second amplifier is a differential amplifier comprising a first input that receives a reference voltage and a second input that receives the regulated voltage via the feedback loop.

3. The voltage regulator of claim 1, wherein the first amplifier extends a phase margin of the voltage regulator toward a high frequency.

4. The voltage regulator of claim 1, wherein the transistor comprises a drain electrode that is connected to a supply voltage and a source electrode that is connected to a ground voltage, and a gate electrode that is connected to the summer.

5. The voltage regulator of claim 1, wherein the transistor has a cascode structure including at least two transistors connected in series.

6. The voltage regulator of claim 5, wherein the at least two transistors comprises a first transistor serving as a common emitter or a common source and a second transistor serving as a common base or a common gate.

7. A voltage regulator comprising:

a first amplifier comprising an impedance translating transistor and generating a first voltage output;

a second amplifier generating a second voltage output; and a pass transistor connected to the first amplifier and generating a regulated voltage based on a voltage output of the first amplifier, wherein the first amplifier has a first gain and a first frequency bandwidth, and the second amplifier has a second gain that is lower than the first gain and a second frequency bandwidth that is higher than the first frequency bandwidth.

8. The voltage regulator of claim 7, wherein the first amplifier is a long tailed differential amplifier.

9. The voltage regulator of claim 8, wherein the long tailed differential amplifier comprises a first transistor and a second transistor connected in series, and a third transistor and a fourth transistor connected in series, and the second transistor and the fourth transistor are connected to the impedance translating transistor.

10. The voltage regulator of claim 9, wherein the first transistor and the third transistor form a current mirror, and collector circuits of the first transistor and the third transistor are connected to a supply voltage.

11. The voltage regulator of claim 10, wherein the first amplifier sets a current in the second amplifier.

12. The voltage regulator of claim 11, wherein the second amplifier mirrors its current to the pass transistor.

13. The voltage regulator of claim 9, wherein the second transistor and the fourth transistor provide a tail current to a source of the impedance translating transistor.

14. The voltage regulator of claim 13, wherein a tail current source of the first amplifier serves as a summer by translating impedance from a high impedance of the second amplifier to a low impedance of the first amplifier.

15. The voltage regulator of claim 9, wherein the second amplifier is implemented as a high-gain folded cascode.

16. The voltage regulator of claim 9, wherein the third transistor and the pass transistor have a substantially similar channel length.

17. The voltage regulator of claim 16, wherein first current flowing from the first transistor is substantially similar to third current flowing from the third transistor, and wherein second current flowing through the pass transistor is substantially similar to the third current flowing through the third transistor.

18. The voltage regulator of claim 7, wherein a voltage at an output of the second amplifier provides self-biasing.

19. The voltage regulator of claim 7, further comprising a feedback loop, wherein each of the first amplifier and the second amplifier is a differential amplifier comprising a first input that receives a reference voltage and a second input that receives the regulated voltage via the feedback loop.

20. The voltage regulator of claim 7, wherein the first amplifier extends a phase margin of the voltage regulator toward a high frequency.

* * * * *